US007887022B2

(12) United States Patent
Von Limburg et al.

(10) Patent No.: US 7,887,022 B2
(45) Date of Patent: Feb. 15, 2011

(54) FORMWORK SYSTEM

(75) Inventors: Felix Von Limburg, Magdeburg (DE); Bernd Schreyer, Hockenheim (DE)

(73) Assignee: B.T. Innovation GmbH, Magdeburg (DE)

( * ) Notice: Subject to any disclaimer, the term of this patent is extended or adjusted under 35 U.S.C. 154(b) by 494 days.

(21) Appl. No.: 11/886,163

(22) PCT Filed: Dec. 21, 2005

(86) PCT No.: PCT/EP2005/013807

§ 371 (c)(1),
(2), (4) Date: Apr. 30, 2008

(87) PCT Pub. No.: WO2006/094547

PCT Pub. Date: Sep. 14, 2006

(65) Prior Publication Data

US 2009/0045316 A1 Feb. 19, 2009

(30) Foreign Application Priority Data

Mar. 11, 2005 (DE) ..... 20 2005 003 979 U

(51) Int. Cl.
*B28B 17/00* (2006.01)
*E04G 17/00* (2006.01)

(52) U.S. Cl. ..... 249/139; 249/189; 249/205; 425/3; 425/DIG. 33; 248/206.5

(58) Field of Classification Search ..... 249/22, 249/24, 120, 134, 139, 155, 160, 163, 169, 249/189, 192, 9, 127, 187.1, 205, 219.1, 249/135; 425/3, DIG. 33; 52/396.04; 403/409.1; 248/148, 149, 206.5, 214, 215, 220.21, 229.12, 248/229.15

See application file for complete search history.

(56) References Cited

U.S. PATENT DOCUMENTS 1,329,177 A * 1/1920 Heltzel ..... 249/3

(Continued)

FOREIGN PATENT DOCUMENTS

DE 29 07 508 A1 9/1980

(Continued)

OTHER PUBLICATIONS

WO 02/079595 A1.*

(Continued)

*Primary Examiner*—Philip C Tucker
*Assistant Examiner*—Dimple N Bodawala
(74) *Attorney, Agent, or Firm*—Flynn, Thiel, Boutell & Tanis, P.C.

(57) ABSTRACT

The invention relates to a formwork system with a formwork support preferably for supporting at least one formwork piece, and a magnet device, movably coupled to the formwork support, for fixing the position of the formwork support on a formwork base, wherein the magnet device has a magnet member, which can be transferred between a raised position, in which the formwork support can be moved together with the magnet device relative to the formwork base, and a lowered position in which the formwork system is magnetically fixed relative to the formwork base. Advantageously, with the present invention the magnet device for transferring the magnet member between the raised position and the lowered position is movable relative to the formwork support.

20 Claims, 9 Drawing Sheets

U.S. PATENT DOCUMENTS

| | | | | | |
|---|---|---|---|---|---|
| 1,651,787 | A | * | 12/1927 | Venable | 249/6 |
| 3,034,613 | A | * | 5/1962 | Heltzel | 403/22 |
| 3,170,217 | A | * | 2/1965 | Williams | 249/189 |
| 3,319,989 | A | * | 5/1967 | Ross | 294/65.5 |
| 4,846,437 | A | * | 7/1989 | Fitzgerald | 249/3 |
| 5,096,155 | A | | 3/1992 | Fitzgerald | |
| 5,261,635 | A | * | 11/1993 | Flathau | 249/7 |
| 5,273,251 | A | * | 12/1993 | Badstieber | 249/189 |
| 5,656,194 | A | * | 8/1997 | Zimmerman | 249/160 |
| 6,106,185 | A | * | 8/2000 | Isele et al. | 403/297 |
| 6,202,978 | B1 | * | 3/2001 | Vappula | 249/187.1 |
| 6,536,737 | B1 | * | 3/2003 | Davis | 249/3 |
| 6,547,209 | B1 | | 4/2003 | Vappula | |
| 6,742,759 | B2 | * | 6/2004 | Vappula | 249/139 |

FOREIGN PATENT DOCUMENTS

| | | | | |
|---|---|---|---|---|
| DE | 3402208 | A1 | * | 7/1985 |
| DE | 297 07 436 | U1 | | 9/1997 |
| DE | 199 61 062 | A1 | | 6/2001 |
| EP | 945237 | A2 | * | 9/1999 |
| EP | 1 075 917 | A2 | | 2/2001 |
| JP | 02293104 | A | * | 12/1990 |
| JP | 2001-129815 | A | * | 5/2001 |
| WO | WO 02/079595 | A1 | * | 10/2002 |

OTHER PUBLICATIONS

International Search Report dated May 29, 2006 (3 pages).

* cited by examiner

A-A
B-B
2
20
21
22
23
24
25
26
A
B

FORMWORK SYSTEM

The invention relates to a formwork system with a formwork support preferably for supporting at least one formwork piece, and a magnet device, movably coupled to the formwork support, for fixing the position of the formwork support on a formwork base, wherein the magnet device has a magnet member, which can be transferred between a raised position, in which the formwork support can be moved together with the magnet device relative to the formwork base, and a lowered position in which the formwork system is magnetically fixed relative to the formwork base.

A generic formwork system is known in which a magnet member which can be movably coupled to a formwork support can be swiveled about a swivel axis between a raised position and a lowered position in the coupled state.

With formwork systems of this nature there is the problem that due to the swivel movement of the magnet member from the raised position into the lowered position, significant forces often occur with force components in the plane of the formwork support, which move or twist the already positioned and accurately mutually aligned formwork elements or formwork supports such that precise positioning of the formwork supports with respect to one another is made more difficult.

In order to remedy the disadvantages known from the state of the art, the invention provides for a formwork system of the type mentioned in the introduction, wherein the magnet device for displacing the magnet member is movable between the raised position and the lowered position with respect to the formwork support. The magnet device is generically movably coupled to the formwork support, but according to the invention it can also be simultaneously displaced with respect to the formwork support. This has the advantage that the magnet member together with the formwork support can be displaced and first precisely positioned, because the magnet member and the formwork support are coupled, but the magnet member can also be moved between the raised position and the lowered position in an essentially translational movement whilst avoiding swiveling. In doing this, forces with force components in the plane of the formwork base can be largely avoided, which can displace or twist the already positioned and accurately mutually aligned formwork elements or formwork supports. With the formwork system according to the invention, a formwork piece can be positioned more simply and precisely than is possible in the state of the art.

To create a formwork system according to the principle of a modular concept in which the magnet devices and formwork supports can be interchanged, it is particularly advantageous if the magnet device and the formwork support are detachably coupled to one another.

The mechanical implementation of a guide device for transferring the magnet member between the raised position and the lowered position can be arranged particularly simply if the magnet member can be transferred in an essentially linear movement between the raised position and the lowered position.

The transverse forces, which act parallel to the formwork base and could cause displacement or twisting of the already positioned and aligned formwork supports, can be almost completely prevented if the direction of the linear transfer movement runs essentially perpendicular to the formwork base.

In a preferred embodiment of the invention the formwork system comprises at least one guide device with at least one guide section and at least one receptacle section, wherein the guide section can be preferably brought into detachable engagement with the receptacle section. A guide device of this nature can be particularly simply and economically manufactured with little production expense, wherein an easily detachable but, however, strong coupling between the magnet member and the formwork support can be realized.

In order to prevent penetration of concrete into a gap between a formwork piece and the formwork base when filling the formwork with concrete, it has been found to be helpful if the magnet device exerts a force on the formwork support in the lowered position of the magnet member to press the formwork support against the formwork base. In doing this also a formwork piece borne by the formwork support is firmly pressed against the formwork base, by means of which the size of the gap between the contact surfaces of the formwork part and the formwork base can be reduced.

The holding force of the magnet member can be particularly well transferred to the formwork support if the guide section is permanently joined to the magnet member.

Strong coupling of the magnet device to the formwork support and a particularly uniform guidance can be realized in this way such that the guide device comprises at least two guide sections which protrude on different sides of the magnet member, located essentially on one axis.

In an embodiment of the invention, which is preferred because it is particularly simple to manufacture, the receptacle section comprises a preferably longitudinal groove and the guide section comprises a projection which protrudes into the groove.

An easily detachable coupling of the magnet device to the formwork support can in this way be realized in that the groove is open at one end.

A strong coupling of the magnet device to the formwork support and a particularly uniform guidance can also be realized in that the formwork support comprises at least two receptacle sections which are arranged spaced from one another in the longitudinal direction of the formwork support.

An important aspect of the invention is a formwork support of a particularly strong construction suitable for the formwork system according to the invention, the formwork support comprising a longitudinal profile with an essentially C-shaped cross-section, wherein the profile has a back and two limbs which protrude essentially perpendicularly from it. The formwork support of this design can also be used independently of the formwork system according to the invention.

With a particularly flexurally strong and torsionally stiff embodiment of the formwork support, the formwork support comprises at least one essentially flat stiffening element which extends essentially perpendicular to the back and/or perpendicular to the limbs of the C-profile. This particularly flexurally strong and torsionally stiff formwork support is characterized furthermore by a low weight and low manufacturing costs.

The rigidity and stability of the formwork support can be further increased if the stiffening element joins the limbs of the profile together.

The rigidity and stability of the formwork support can be further increased if the stiffening element joins the back of the profile with at least one of the limbs.

In order to simplify the mounting of a formwork piece on the formwork support, it is advantageous if the formwork support has at least one opening on the back of the profile in the region between two stiffening elements.

The number of required components for the formwork support, and therefore also its weight and production expense, can be reduced in that the stiffening element is formed as the receptacle section.

In a particularly advantageous embodiment of the invention, the limbs of the profile are of different lengths. A formwork support with a design of this nature offers, at a minimum weight, the advantage of an optimum force distribution when, during the filling of the formwork mould with concrete, the weight of the liquid concrete acts on the formwork or formwork supports.

In a particularly preferred embodiment of the invention, the formwork support is formed as the formwork and comprises at least one formwork surface.

In a preferred formwork system, which, apart from the already mentioned advantages, offers the user the advantage of greater flexibility through the provision of a large number of adjustment options for the magnet device, the formwork support has at least three receptacle sections, which are preferably equally spaced from one another in the longitudinal direction of the formwork support.

In a particularly preferred embodiment of the invention, the guide device has a link guide in which the guide section can be guided in a sliding manner.

In order to prevent, as far as possible during the transfer of the magnet member between the raised and lowered positions, forces occurring which could cause an unwanted displacement or twisting of an already positioned formwork support on the formwork base, it is particularly advantageous if a guide direction of the link guide runs approximately perpendicular to the longitudinal direction of the formwork support.

Preferably the link guide here extends over a length which corresponds approximately to half the spacing of the limbs on the C-profile.

The essential features and preferred embodiments of the invention are described in the following with reference to the enclosed drawings.

DETAILED DESCRIPTION OF THE DRAWINGS

Figures 1A, 1B, 1C, 1D:
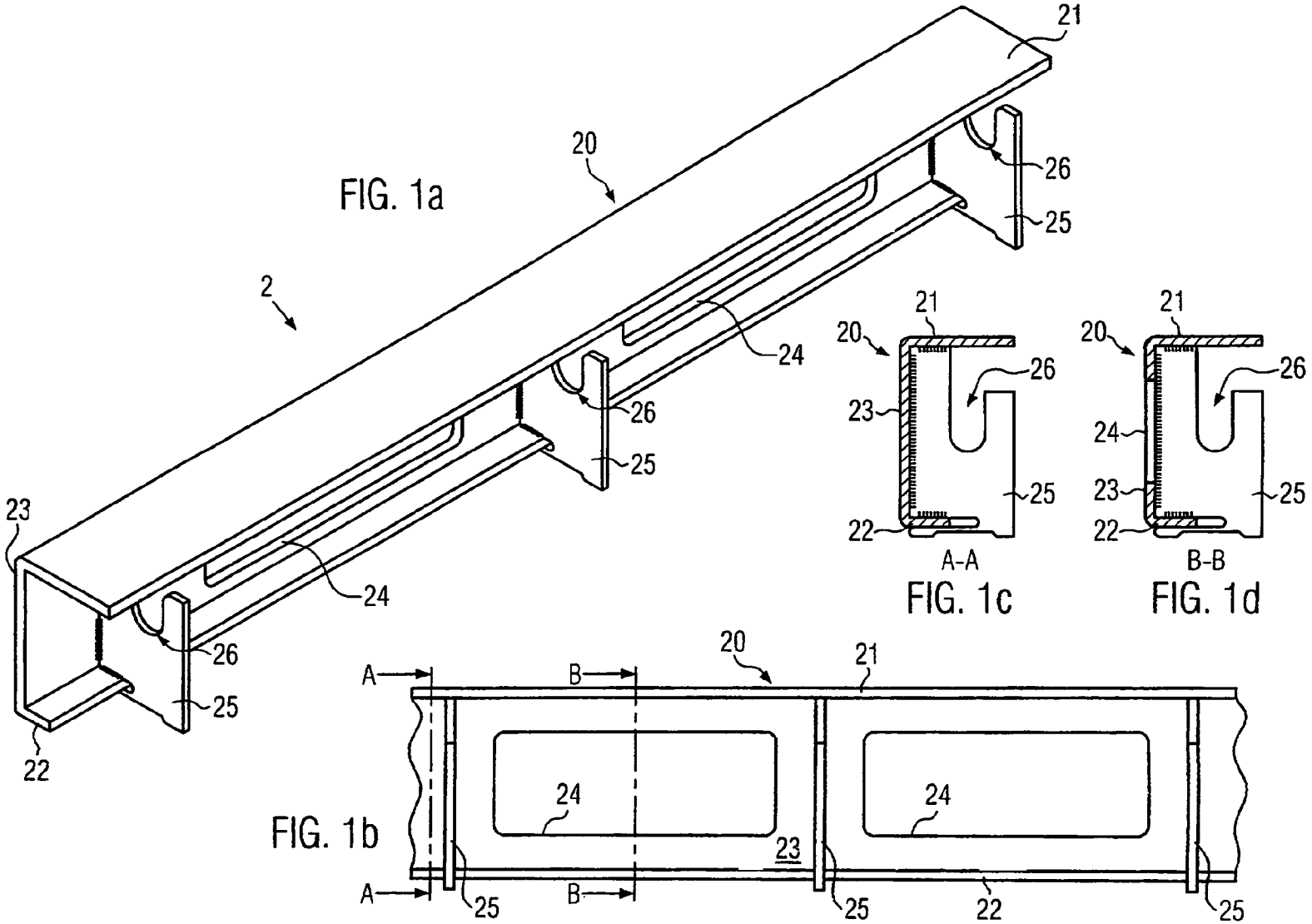
FIG. 1*a* illustrates a formwork support for the formwork system according to the invention in a first embodiment with a profile member which is C-shaped in cross-section.
FIG. 1*b* illustrates a side view of the formwork support from FIG. 1*a*.
FIG. 1*c* illustrates a section A-A of the formwork support from FIG. 1*b*.
FIG. 1*d* illustrates a section B-B of the formwork support from FIG. 1*b*.

In the following description terms stating position, such as "upper", "lower", "left", "right" or similar terms, are used for better comprehension of the description of the invention. These positional designations should only be taken to refer in each case to the respective illustration of the drawing and have no binding character beyond this.

The invention relates in particular to a formwork system 1, illustrated in FIGS. 4*a* to 4*f* and 5*a* to 5*f*, with a formwork support 2 for bearing a formwork piece 10, and a magnet device 3, which can be movably coupled to the formwork support 2, for fixing the position of the formwork support 2 on a formwork base 4, wherein the magnet device 3 has a magnet member 30, which can be transferred between a raised position illustrated in FIGS. 4*c*, 4*d* and 5*c*, 5*d*, in which the formwork support 2 together with the magnet device 3 can be moved with respect to the formwork base 4, and a lowered position illustrated in FIGS. 4*e*, 4*f* and 5*e*, 5*f*, in which the formwork system 1 is magnetically fixed with respect to the formwork base 4. For the transfer of the magnet member 30 or the magnet device 3 between the raised position and the lowered position, the magnet device 3 can be displaced with respect to the formwork support 2. The raised position of the magnet member 30 or of the magnet device 3 in a coupled state with the formwork support 2 is in particular illustrated in FIGS. 4*c*, 4*d* as well as 5*c* and 5*d*. The lowered position of the magnet member 30 or of the magnet device 3 in a coupled state with the formwork support 2 is in particular illustrated in FIGS. 4*e*, 4*f* as well as 5*e* and 5*f*.

In the following, the main features of the formwork support 2 of a first embodiment are explained with reference to FIGS. 1*a* to 1*d*.

FIG. 1*a* illustrates an overall view of the formwork support 2 of the first embodiment in an overall view. The formwork support 2 of the first embodiment comprises a longitudinal profile member 20, which is essentially C-shaped in cross-section, with an upper limb 21, a lower limb 22 and a back 23 joining the limbs 21, 22. The upper and lower limbs 21, 22 each protrude perpendicularly from the back 23 of the C-profile 20, as illustrated in the sectional views of FIGS. 1*c* and 1*d*, wherein the limbs 21, 22 are of different lengths and the upper limb 21 is longer or protrudes further from the back 23 than the lower limb 22. The C-shaped profile member 20 can essentially be of any length. In the C-profile 20, as particularly clearly illustrated in FIGS. 1*a*, 1*c* and 1*d*, between the limbs 21, 22, in each case, identical, flat stiffening elements 25 are welded at equal spacing to one another. These flat stiffening elements 25 are preferably cut or punched out of a sheet in the shape illustrated in FIGS. 1*a* to 1*d*. These flat stiffening elements 25, which are welded to the C-profile 20, are used for stiffening the formwork support 2 and for accommodating or coupling guide sections 36 of the magnet device 3 and are also designated as receptacle sections 25 in the following in conjunction with the formwork support 20 of the first embodiment. That is, the joining sections 25 are formed as receptacle sections 25 for the purpose of the invention and have a double function—on one hand, stiffening of the formwork support 2, and, on the other hand, a coupling point for the magnet device 3.

With reference to FIGS. 1*a*, 1*c* and 1*d*, the main features of the stiffening elements 25 formed as receptacle sections 25 are described below. The receptacle sections 25 have two limbs of different lengths, which essentially extend in a parallel direction and between them form a U-shaped gap 26. The longer limb—the right one in the illustration of the FIGS. 1*c* and 1*d*—has a length which essentially corresponds to the spacing of the upper and lower limbs 21, 22 of the C-shaped profile member 20. The gap 26 separating the two limbs of the receptacle section 25 essentially runs parallel to the left and right outside edges of the receptacle section 25 and extends approximately over half the length of the right outside edge on the upper rim of the material of the receptacle section 25. At the lower end of the receptacle section 25, a U-shaped slot is provided from the left rim, which extends over approximately half the width of the receptacle section 25 into the interior of the material of the receptacle section 25 and runs essentially parallel to the lower edge of the receptacle section 25. This slot is provided for the accommodation of the lower limb 22 of the C-profile 20 and is dimensioned appropriately in width. The longer limb of the receptacle section 25 is, as illustrated in the FIGS. 1*c* and 1*d*, adapted to the spacing of the upper and lower limbs 21, 22 of the profile member 20 and, in the installed state, is brought into contact with the two limbs 21, 22 and the back 23 and welded, which is symbolically represented by the marks. This projection around the lower limb 22 of the C-shaped member 20 has the purpose of spacing the lower limb 22 from the formwork base 4 during use, thus reducing the contact area of the formwork support 20. To further reduce the contact area the lower edge of the projection can, as illustrated in FIGS. 1*a*, 1*c* and 1*d*, be recessed inwards. In this way any unevenness in the formwork base 4 is compensated for and precise positioning of the formwork support 20 on the formwork base 4 is facilitated. The projection at the lower end of the receptacle section 25, which surrounds the lower limb 22 of the C-profile 20, can also be omitted, so that the lower end of the receptacle section 25 is essentially flush with the lower side of the profile member 20, as is illustrated in FIGS. 4*a* to 4*f*.

The receptacle sections 25 are arranged in the longitudinal direction of the profile member 20 with uniform spacing to one another between the limbs 21, 22 and are welded to both limbs 21, 22 and to the back 23 in such a manner that the receptacle sections 25 are parallel to one another and each extends approximately perpendicular to both limbs 21, 22 as well as approximately perpendicular to the back 23 of the C-shaped profile member 20, thus providing a particularly high stiffness to the formwork support 2 so created. Between the receptacle sections 25, window-type openings 24 can be provided on the back of the C-shaped profile member 20 to fasten formwork pieces 10, for example by clamps (not illustrated), in a simple manner to the formwork support 2 without the necessity of having to drill through the back 23 of the profile member 20 at each fastening point. Although only three receptacle sections 25 are illustrated in FIGS. 1*a* and 1*b*, it is pointed out that the length of the formwork support 2 can theoretically be chosen as required and can comprise a large number of receptacle sections 25, wherein at least two adjacent receptacle sections 25 are arranged at a spacing adapted to the magnet device 3 described further below. The formwork support 2 of the first embodiment is furthermore suitable for uses independently of the following described magnet device 3.

Figure 2C:
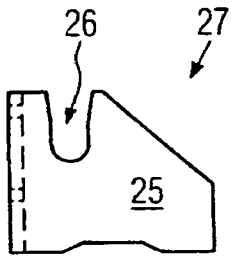
FIG. 2*c* illustrates a side view of the angle bracket from FIG. 2*a*.

The formwork support 2 of the second embodiment, which is realized as an angle bracket 27, will now be described with reference to FIGS. 2*a* to 2*d*. The angle bracket 27, which is illustrated in FIG. 2*a* with an intervening piece 11 and a formwork piece 10, comprises a back provided with a large number of holes and two limbs 25 protruding perpendicular from the back and which are each provided with a groove-type accommodating slot 26 running essentially parallel to the back of the angle bracket 27 from the upper side of the limb. In the plan view of FIG. 2*d* it can be seen that the angle bracket 27 has an essentially C-shaped profile in cross-section. The groove-type accommodating slots 26 are provided at equal spacing from the back of the angle bracket 27 in the limbs of the angle bracket 27 designated as receptacle sections 25 and protrude to the same depth into the material of the receptacle sections 25. The groove-type accommodating slots 26 act as link guides for the sliding guide sections 36 of the magnet device 3 accommodated in them with possible adjustment in a direction parallel to the direction of the transfer movement during the transfer of the magnet member 30 between the raised and lowered positions. The limbs 25 of the angle bracket 27 are beveled at their free upper end.

Figure 2B:
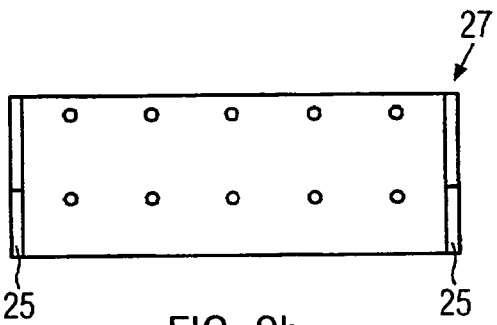
FIG. 2*b* illustrates a front view of the angle bracket from FIG. 2*a*.

FIG. 2*b* illustrates a front view of the angle bracket 27, but without the intervening piece 11 and the formwork piece 10.

FIG. 2*c* illustrates a side view of the angle bracket 27 from FIG. 2*b*.

Figure 2D:
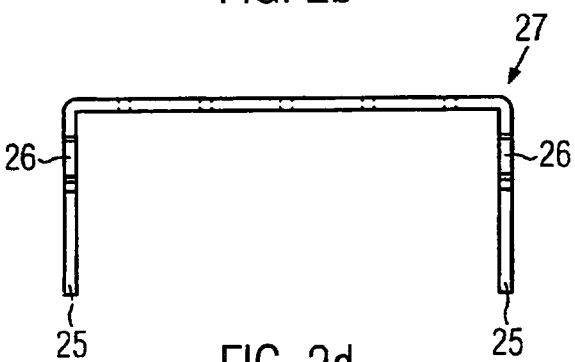
FIG. 2*d* illustrates a plan view of the angle bracket from FIG. 2*a*.
Figure 2A:
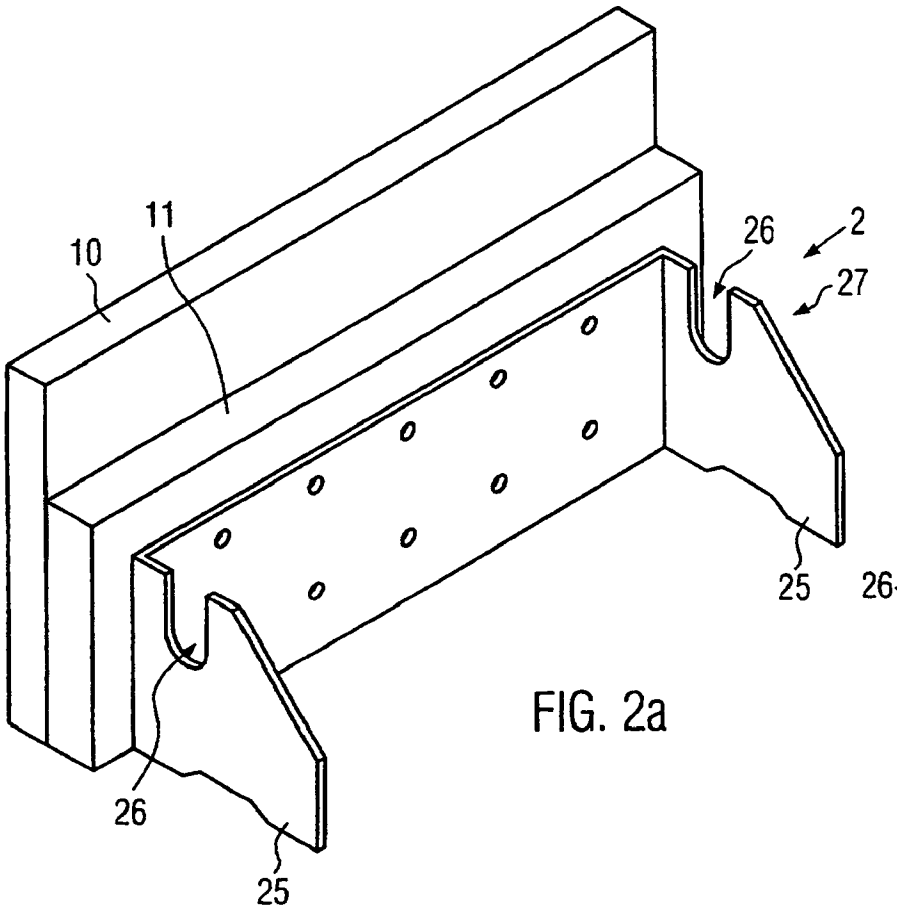
FIG. 2*a* illustrates a formwork support of a second embodiment for the formwork system according to the invention realized as an angle bracket with an intervening piece and a formwork piece.

FIG. 2*d* illustrates a plan view onto the angle bracket 27 of FIG. 2*b*.

In the following, the essential features of the magnet device 3 are described with reference to FIGS. 3*a* to 3*g*. The magnet device 3 comprises an essentially cuboid magnet member 30 on the upper side of which an essentially rectangular metal plate 35 is screwed and/or welded. The outline of the metal plate 35 corresponds essentially to the outline of the magnet member 30 in the plan view, wherein the metal plate 35 is turned through 90° with respect to the magnet member 30, and wherein a broad side of the metal plate 35 is in alignment with a longitudinal side of the cuboid magnet member 30 and the oppositely located end of the metal plate 35 protrudes over the oppositely located longitudinal side of the magnet member 30. On the free end of the metal plate 35, which protrudes over the one longitudinal side of the magnet member 30, a metal bar 36 is welded which extends at right angles to the longitudinal direction of the metal plate 35 and parallel to the longitudinal direction of the magnet member 30 and which protrudes at both ends beyond the length of the magnet member 30. Furthermore, on the upper side of the metal plate 35, a handle 39 is provided for lifting and carrying the magnet device 3. Screw heads are illustrated symbolically to represent the joining of the metal plate to the magnet member 30. On the longitudinal side of the magnet member 30, which aligns with the broad side of the metal plate 35, an eccentric 37 with an eccentric lever 38 is provided, which is fitted so that it can swivel or rotate on the magnet member 30. On the underside of the magnet member 30, which also forms the support side for the support of the magnet member 30 on the formwork base 4, a total of four essentially step-shaped cylindrical holes 31 are provided perpendicular to the underside of the magnet member 30. Step-shaped, essentially cylindrical bolts 33, which form the feet 33 of the magnet device 3, are let into these double-stepped cylindrical holes 31, as is illustrated in FIGS. 3*f* and 3*g*. As is illustrated in FIGS. 3*f* and 3*g*, the feet 33 have an essentially T-shaped cross-section, wherein the contour of the broad head section is essentially adapted to the contour of the accommodating hole 31. In the indentation forming one step, which is introduced into the material of the magnet member 30 from the underside of the magnet member 30, an essentially annular cover 34 is inserted. The cover 34 has a through hole, which essentially matches the diameter of the thinner section of the foot 33, wherein the cover retains the wide head section of the foot 33, so that the foot 33, which is pretensioned by a spring element 32, cannot drop out of the holes 31 when the magnet device 3 is lifted from the formwork base 4.

Figure 3A:
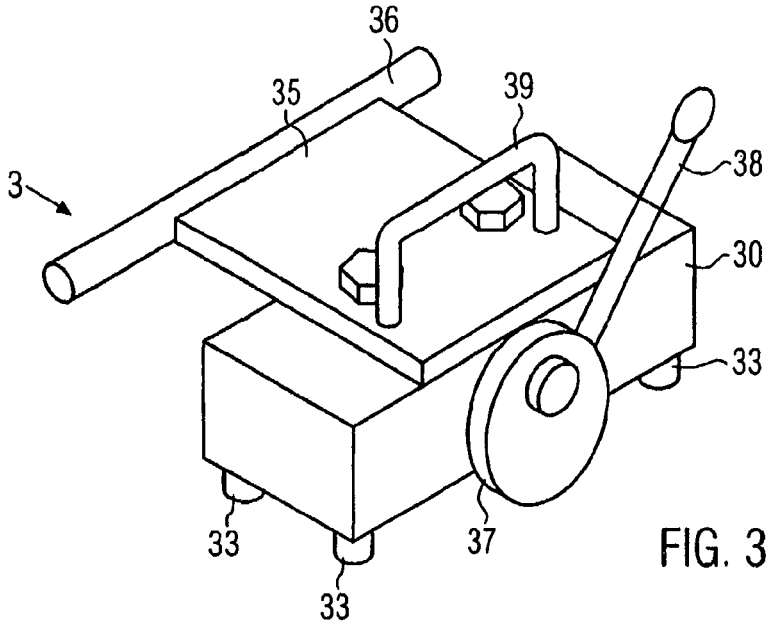
FIG. 3*a* illustrates a magnet device for the formwork system according to the invention in an overall view.
Figure 3B:
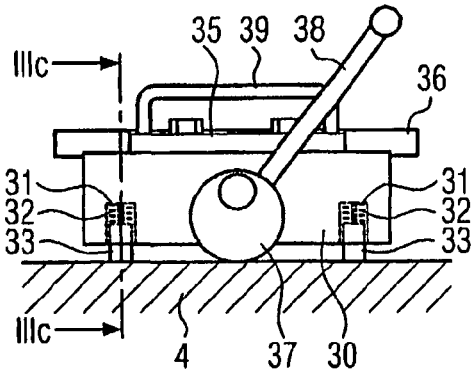
FIG. 3*b* illustrates a front view of the magnet device in a raised position.
Figure 3C:
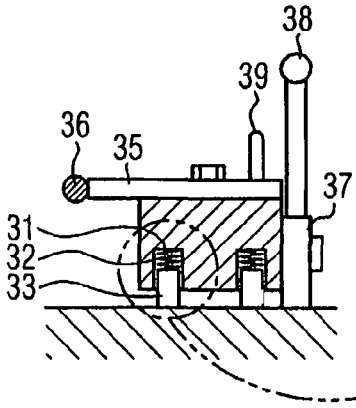
FIG. 3*c* illustrates a sectional view of the magnet device from FIG. 3*b*.
Figure 3F:
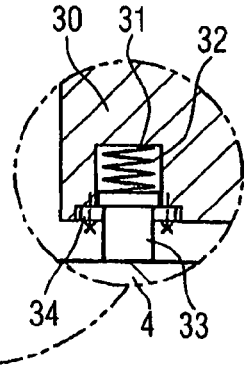
FIG. 3*f* illustrates an enlarged detail view of the magnet device from FIG. 3*c*.

FIGS. 3*b*, 3*c* and 3*f* illustrate the magnet device 3, wherein the magnet member 30 is located in a raised position opposite the formwork base 4. For the sake of simplicity, a simplified illustration has been chosen for illustrating the holes 31, spring elements 32 and feet 33. An illustration with more accurate detail can be seen in FIGS. 3*f* and 3*g*. In the raised position of the magnet member or of the magnet device 3, the feet 33 protrude beyond the underside of the magnet member 30, so that the underside of the magnet member 30 is spaced from the surface of the formwork base 4. The magnetic attractive force of the magnet member 30 on the formwork base is, in the raised position of the magnet member 30 or of the magnet device 3, essentially negligible so that the force exerted on the formwork base 4 essentially corresponds to the weight of the magnet device 3. By rotating the eccentric 37 into an appropriate position, a circumferential section of the eccentric 37 is brought into contact with the formwork base 4, the distance of which to the rotational axis of the eccentric 37 is greater than the distance of the rotational axis to the underside of the magnet member 30. FIG. 3*c* illustrates a sectional view of the magnet device 3 in the raised position and FIG. 3*f* shows a corresponding detailed view of the hole 31, spring element 32, foot 33 and cover 34 of the magnet device 3.

Figure 3D:
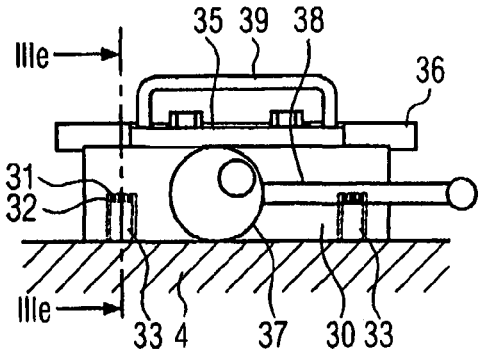
FIG. 3*d* illustrates a front view of the magnet device in a lowered position.
Figure 3E:
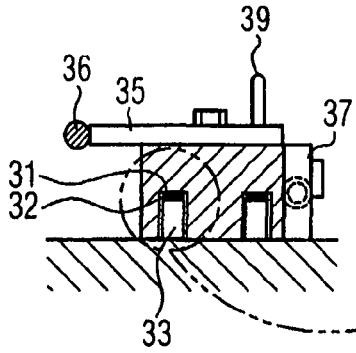
FIG. 3*e* illustrates a sectional view of the magnet device from FIG. 3*d*.
Figure 3G:
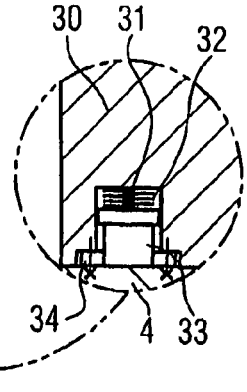
FIG. 3*g* illustrates an enlarged detail view of the magnet device from FIG. 3*e*.

FIGS. 3*d*, 3*e* and 3*g* illustrate the magnet member 30, or the magnet device 3, in a lowered position with respect to the formwork base 4, wherein the feet 33 are fully located in the receptacles 31 and the magnet member 30 develops its full magnetic force. In addition to the weight, the magnetic force 30 developed in interaction with the formwork base 4 and the whole magnet device 3 pulls downward perpendicular to the formwork base 4. The eccentric 37 is here located in a position in which no circumferential section of the eccentric 37 protrudes beyond the underside of the magnet member 30. FIG. 3*g* shows in detail how a foot 33 is pressed inside the hole 31 against the force of the spring element 32 and is fully accommodated inside the hole 31.

In the following, the preferred use of the invention is described with reference to FIGS. 4*a* to 4*f* and to 5*a* to 5*f*.

Figure 4A:
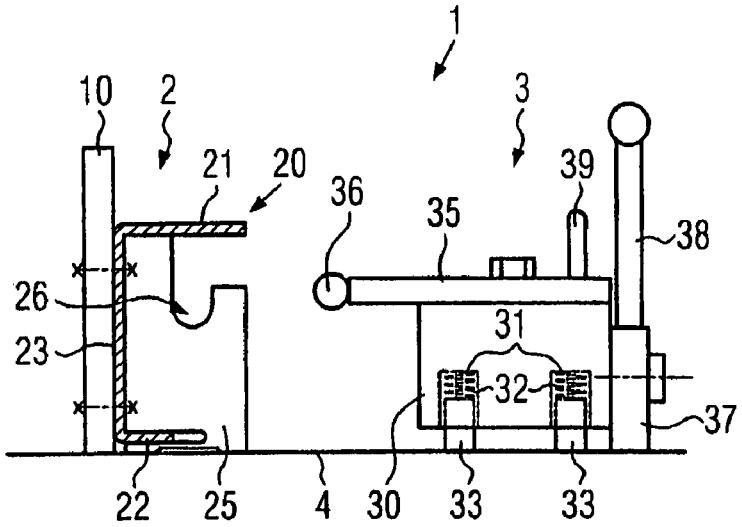
FIG. 4*a* illustrates the formwork system according to the invention with the magnet device and the formwork support of the first embodiment in the decoupled state.
Figure 4B:
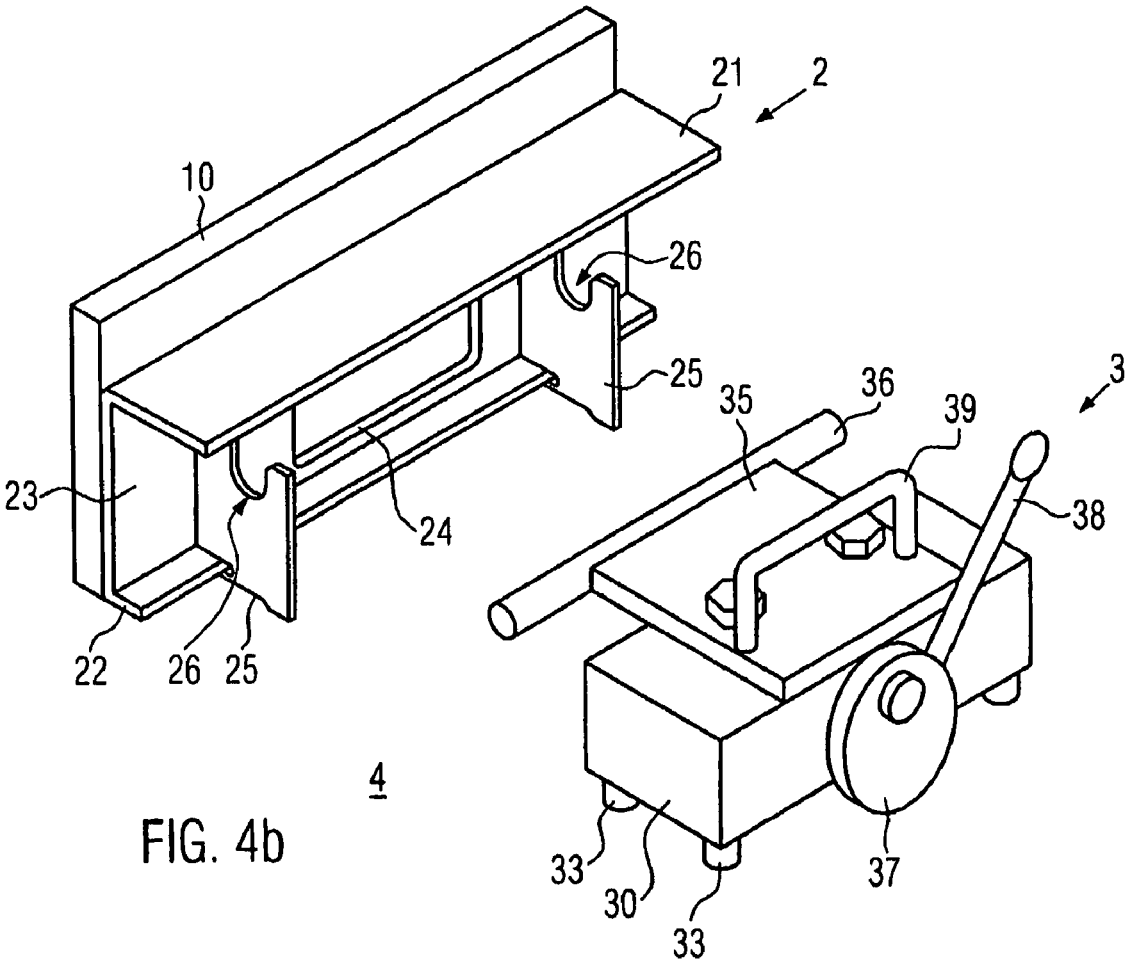
FIG. 4*b* illustrates the formwork system from FIG. 4*a* in an overall view.

FIGS. 4*a* to 4*f* illustrate symbolically the use of the formwork system 1 with the above described magnet device 3 and the above described formwork support 2 of the first embodiment. FIGS. 4*a* and 4*b* illustrate a decoupled state of the formwork device 2 and the magnet device 3. The formwork support 2 stands on a formwork base 4 and carries a formwork piece 10 bolted to the back 23 of the C-shaped profile member 20. In the decoupled state, the magnet device 3 is movable independently of the formwork support 2 with the bolted-on formwork piece 10 and, for example, can be interchanged according to the principle of modular construction.

To produce formwork to be filled with liquid concrete the formwork support 2 is brought with the bolted-on formwork piece 10 into its intended position on the formwork base 4. To couple the magnet device 3 to the formwork support 2, the free ends of the metal bar 36 welded to the metal plate 35 are introduced from above into the U-shaped, groove-type and longitudinally extended accommodating slots 26 of the receptacle sections 25. The groove-type accommodating slots 26 are open at the top and are used as a link guide for the free ends of the metal bar 36 to be arranged in them, which are in the following also designated as guide sections 36. In this link guide 26, the free ends of the metal bar 36 or the guide sections are movably accommodated and can be guided sliding into the lowered position from the raised position during transfer in the direction of movement of the magnet member. The groove-type receptacle 26 can, as illustrated, be open at the upper end or closed in order to couple the magnet device 3 to the formwork support 2 undetachably. In the embodiment illustrated in FIGS. 4*a* to 4*f*, the groove-type receptacle 26 is open at the top and the magnet device 3 is detachably coupled to the formwork support. In the raised position of the magnet member 30, or of the magnet device 3, illustrated in FIGS. 4*c* and 4*d*, the magnet device 3 and the formwork support 2 are already coupled and can be moved together on the formwork base 4. In its raised position the magnetic force of the magnet member 30 acting on the formwork base 4 is negligible, so that on moving the formwork system, i.e. the formwork support 2 with the coupled magnet device 3, only the friction between the two elements due to the weight needs to be overcome.

A guide device for the purpose of the invention comprises, on one hand, the guide sections 36 on the side of the magnet device 3 and, on the other hand, the groove-type accommodating slots 26 in the receptacle sections 25 on the side of the formwork support 2. In the coupled state of the magnet device 3 and of the formwork support 2, the guide sections 36 are engaged positively locked with the receptacle sections 25, wherein the link guide only permits movement of the guide sections 36 in one direction which essentially corresponds to the direction of movement of the magnet device 3 during transfer of the magnet member 30 between the raised and lowered positions. This movement occurs in a linear movement essentially perpendicular to the formwork base 4 so that during the transfer of the magnet member 30 between the raised and lowered positions, no transverse forces occur in parallel to the plane of the formwork base 4 which could cause an unwanted displacement or twisting of the already positioned formwork support 2.

Figure 4C:
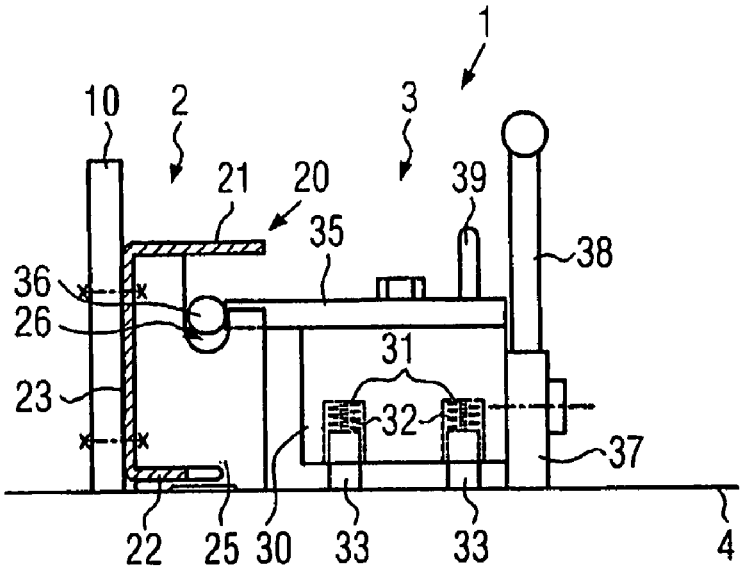
FIG. 4*c* illustrates the formwork system according to the invention with the magnet device and the formwork support of the first embodiment in the coupled state, wherein the magnet device is in the raised position.
Figure 4D:
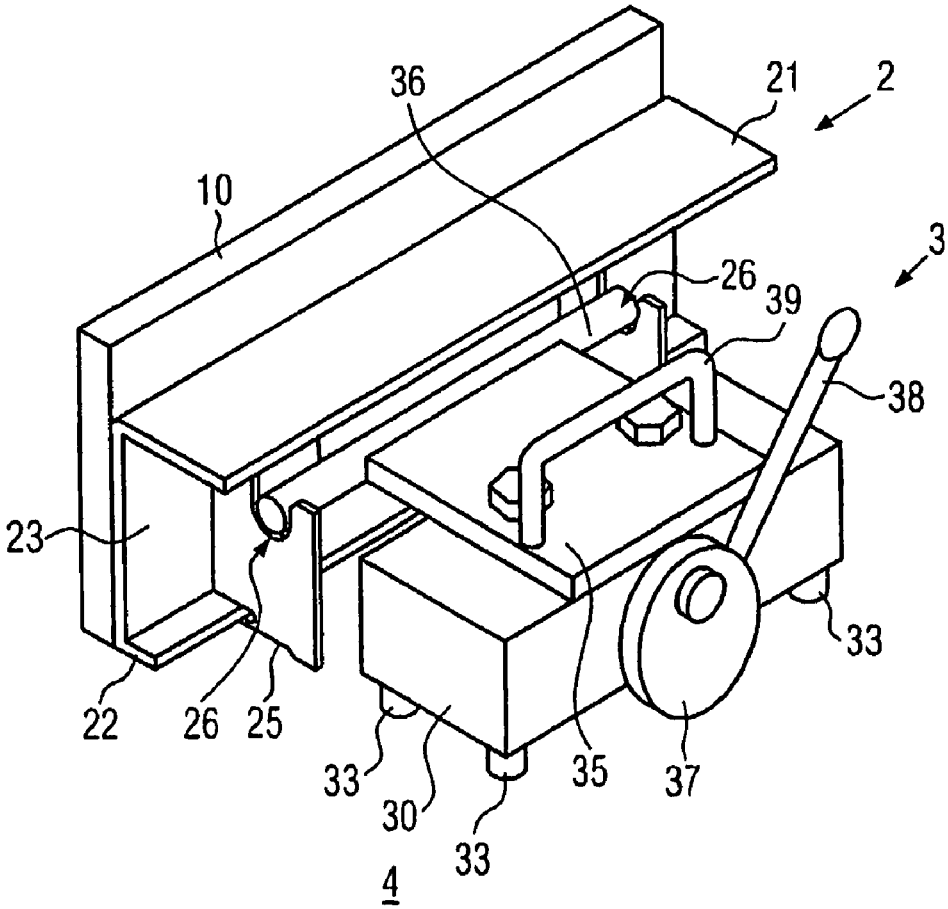
FIG. 4*d* illustrates the formwork system from FIG. 4*c* in an overall view.
Figure 4E:
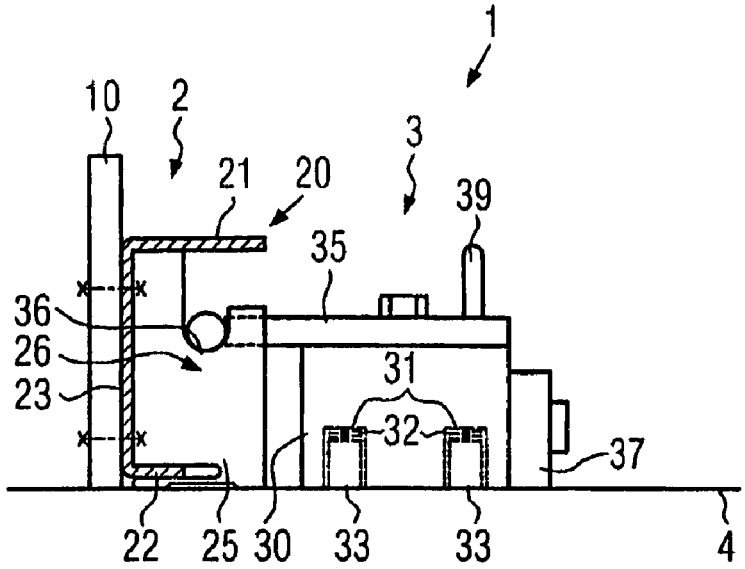
FIG. 4*e* illustrates the formwork system according to the invention with the magnet device and the formwork support of the first embodiment in the coupled state, wherein the magnet device is in the lowered position.
Figure 4F:
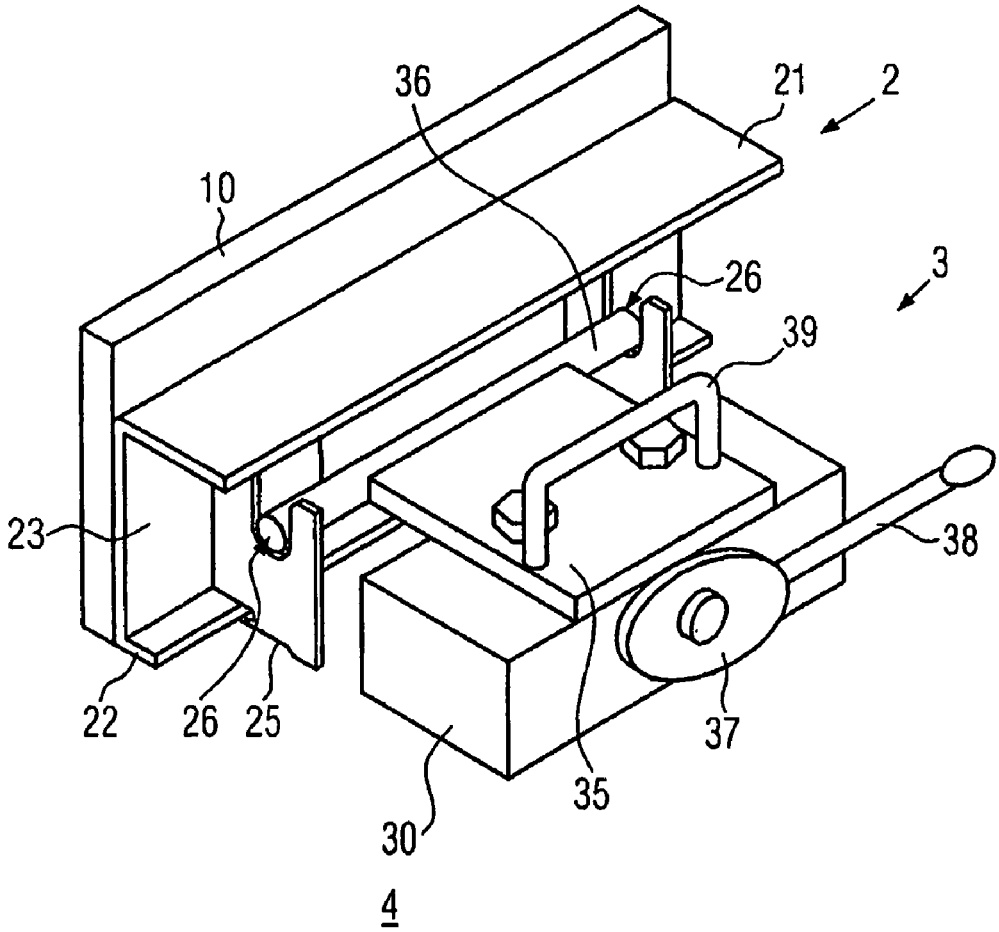
FIG. 4*f* illustrates the formwork system from FIG. 4*e* in an overall view.

For the transfer of the magnet member 30 from the raised position, with respect to the formwork base 4 illustrated in FIGS. 4*c* and 4*d*, into the lowered position illustrated in FIGS. 43 and 4*f*, a compressive force is exerted from above on the magnet device 3, for example by treading with a foot or similar action. In doing this, the guide sections 36 in the groove-type accommodating slots 26 or in the link guide are moved sliding essentially perpendicular to the formwork base 4. The magnet device 3 can be moved with respect to the formwork support 2 for the transfer of the magnet member 30 between the raised position and the lowered position and, in this particular case, in a linear movement, the direction of which essentially runs perpendicular to the surface of the formwork base 4.

On pressing down the magnet device 3 perpendicularly onto the formwork base 4, the spring forces of the spring elements 32 are overcome, which pretension the feet 33 and permit them to protrude beyond the underside of the magnet member 30 so that the underside of the magnet member 30 is spaced from the formwork base 4. The eccentric 37, which is supported for swiveling about the swivel axis, is, as is illustrated in FIGS. 4*e* and 4*f*, automatically rotated into a position in which no circumferential section on the eccentric 37 protrudes beyond the underside of the magnet member 30. The swivel axis of the eccentric 37 extends essentially parallel to the formwork base 4. The spring elements 32 are compressed against their spring force and the feet 33 are fully accommodated inside the accommodating holes 31, so that no section of the feet 33 protrudes beyond the underside of the magnet member 30. Here, the magnet member 30 is brought with its underside flat in contact on the formwork base 4 until it develops its full magnetic force. Furthermore, in the lowered position of the magnet member 30 or of the magnet device 3, the formwork support 2 is pressed via the metal plate 35 and the metal bar 36 welded to it onto the formwork base 4. In the course of this, the free ends of the metal bar 36 located in the groove-type accommodating slots 26 of the receptacle sections 25, or the guide sections 36, press against the bottom of the U-shaped receptacle so that the position of the formwork system 1 is fixed on the formwork base 4.

From the lowered position illustrated in FIGS. 4*e* and 4*f*, the magnet member 30 or the magnet device 3 can be transferred again from the lowered position into the raised position illustrated in FIGS. 4*c* and 4*d* by rotating the eccentric 37 through actuating the eccentric lever 38. The procedure illustrated in FIGS. 4*a* to 4*f* can be repeated as often as required. For example, the magnet device 3 can be interchanged and, for example, as illustrated in FIGS. 5*a* to 5*f*, it can be used for another application.

When all the required formwork pieces 10 are positioned in the manner described above so that a closed formwork is produced, the formwork can be filled with liquid concrete. Once the concrete has hardened, the formwork or the single formwork systems 1 are released in the described manner.

FIGS. 5*a* to 5*f* illustrate a preferred use of the formwork system according to the invention with the magnet device 3 and the formwork support 2 of the second embodiment implemented as a fastening means 27, which is essentially the same as the use previously described in conjunction with FIGS. 4*a* to 4*f*. In contrast to the formwork support 2 of the first embodiment, the angle bracket 27 is specially provided for fastening a singe magnet device 3. A formwork piece 10 is screwed to the angle bracket 27 on its back and brought into its intended position on the formwork base 4. In the state illustrated in FIGS. 5*a* and 5*b*, the magnet device 3 is decoupled from the angle bracket 27. For coupling the magnet device 3 to the formwork support 2, the free ends of the metal bar 36 or the guide sections are introduced or lowered into the groove-type accommodating slots 26 in the receptacle sections 25 of the angle bracket 27 from above so that the guide sections 36 become engaged with the limbs or receptacle sections 25 of the angle bracket 27. In the coupled state of the magnet device 3 and the formwork support 2, the guide sections 36 can move sliding in the groove-type accommodating slots 26 of the receptacle sections 25, which act as a link guide, in the direction of movement of the magnet member 30 when transferring between the raised and lowered positions in a linear movement essentially perpendicular to the formwork base 4. In this way the magnet device 3 can move with respect to the formwork support 2 for transferring the magnet member 30 between the raised and lowered positions. In the state illustrated in FIGS. 5*c* and 5*d*, the magnet device 3 is detachably coupled to the formwork support 2 and the magnet device 3 and the formwork support 2 can move together and in the coupled state on the formwork base 4. By exerting a compressive force, for example by treading on the upper side of the magnet member 30, the magnet member 30 or the magnet device 3 is transferred from the raised position illustrated in FIGS. 5*c* and 5*d* into the lowered position illustrated in FIGS. 5*e* and 5*f*. To do this, the spring force, which pushes the feet 33 out beyond the underside of the magnet member 30, is overcome and the eccentric 37 is brought into a position in which no circumferential section protrudes beyond the underside of the magnet member 30. In the lowered position of the magnet member 30 or magnet device 3 illustrated in FIGS. 5*e* and 5*f*, the underside of the magnet member 30 is in flat contact with the surface of the formwork base 4. Here, the magnet member 30 develops is full magnetic force and, via the metal bar 36 welded onto the metal plate 35, presses the angle bracket 27 firmly onto the formwork base 4.

Figure 5A:
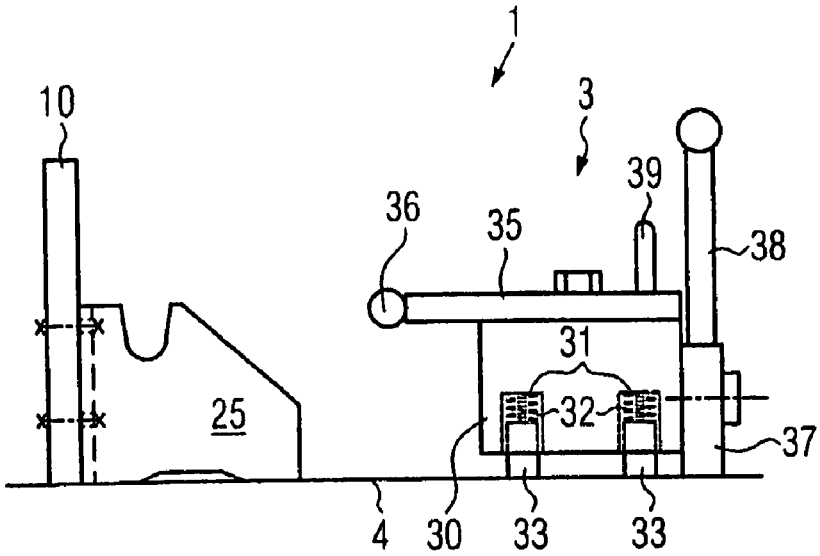
FIG. 5*a* illustrates the formwork system according to the invention with the magnet device and the formwork support of the second embodiment realized as an angle bracket in the decoupled state.
Figure 5B:
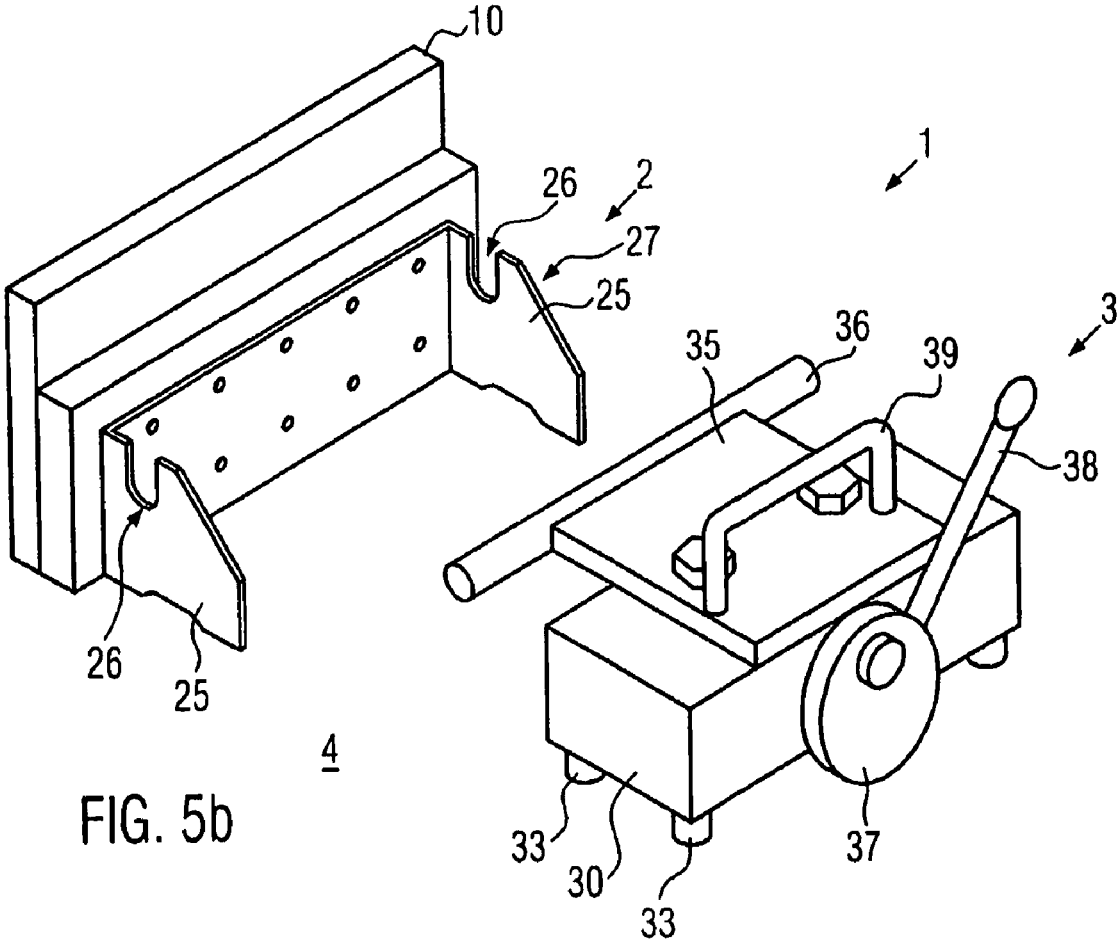
FIG. 5*b* illustrates the formwork system form FIG. 5*a* in an overall view.
Figure 5C:
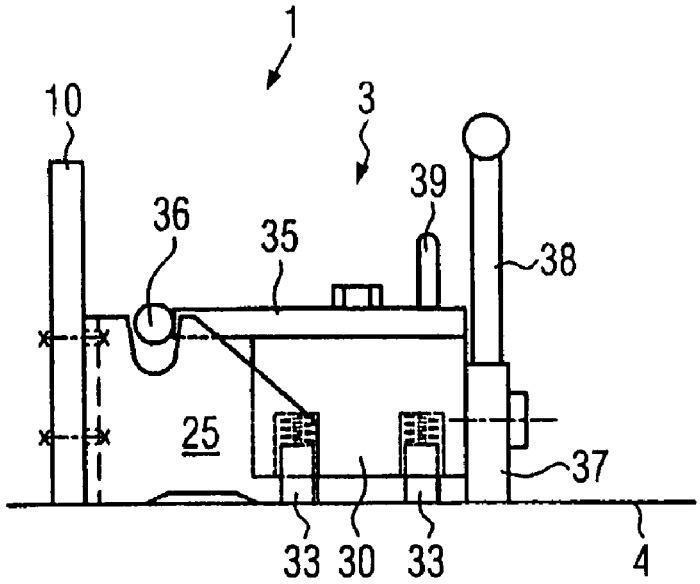
FIG. 5*c* illustrates the formwork system according to the invention with the magnet device and the formwork support of the second embodiment realized as an angle bracket in the coupled state, wherein the magnet member is in the raised position.
Figure 5D:
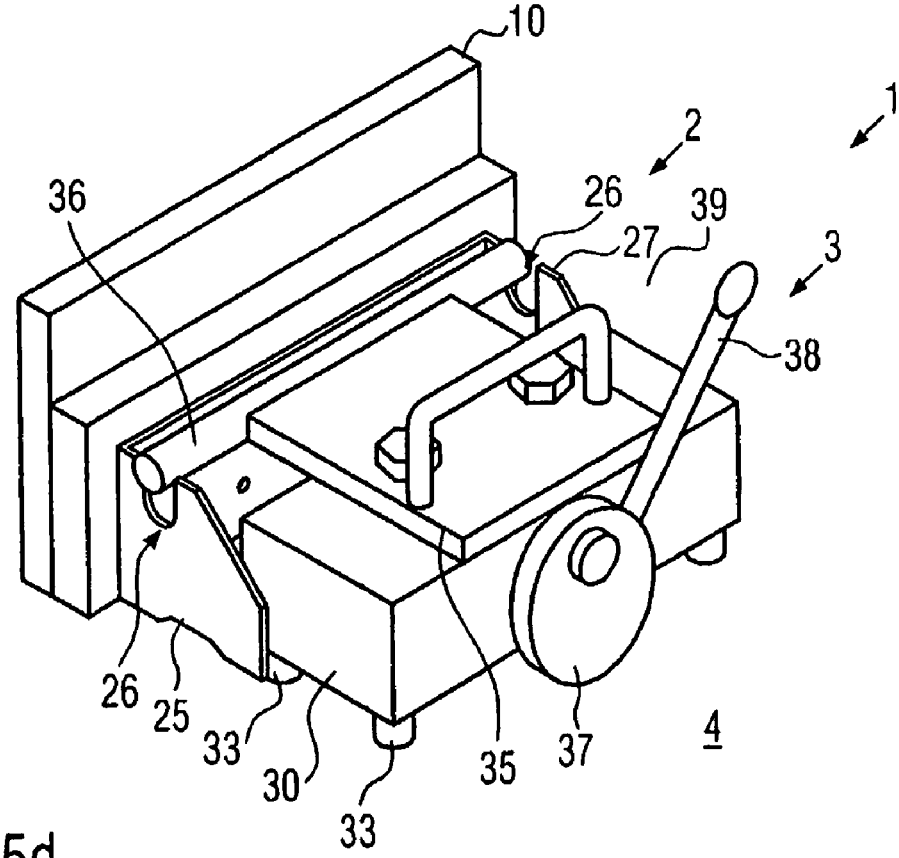
FIG. 5*d* illustrates the formwork system from FIG. 5*c* in an overall view.
Figure 5E:
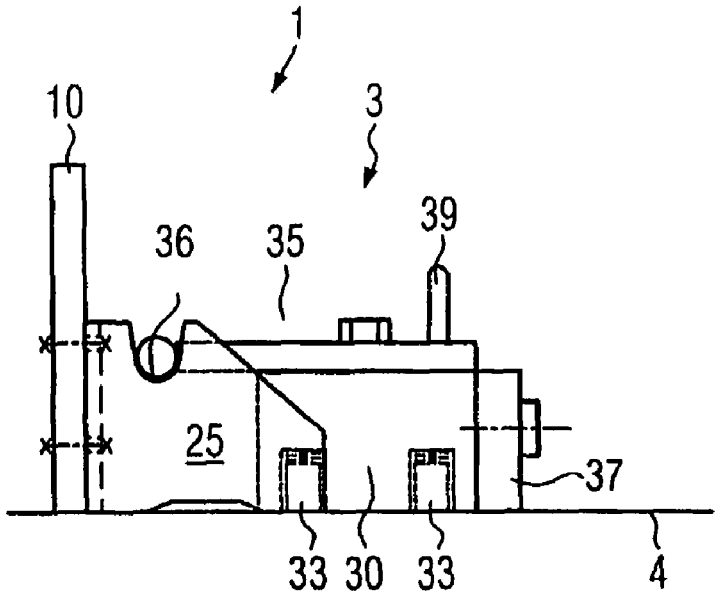
FIG. 5*e* illustrates the formwork system according to the invention with the magnet device and the formwork support of the second embodiment realized as an angle bracket in the coupled state, wherein the magnet device is in the lowered position.
Figure 5F:
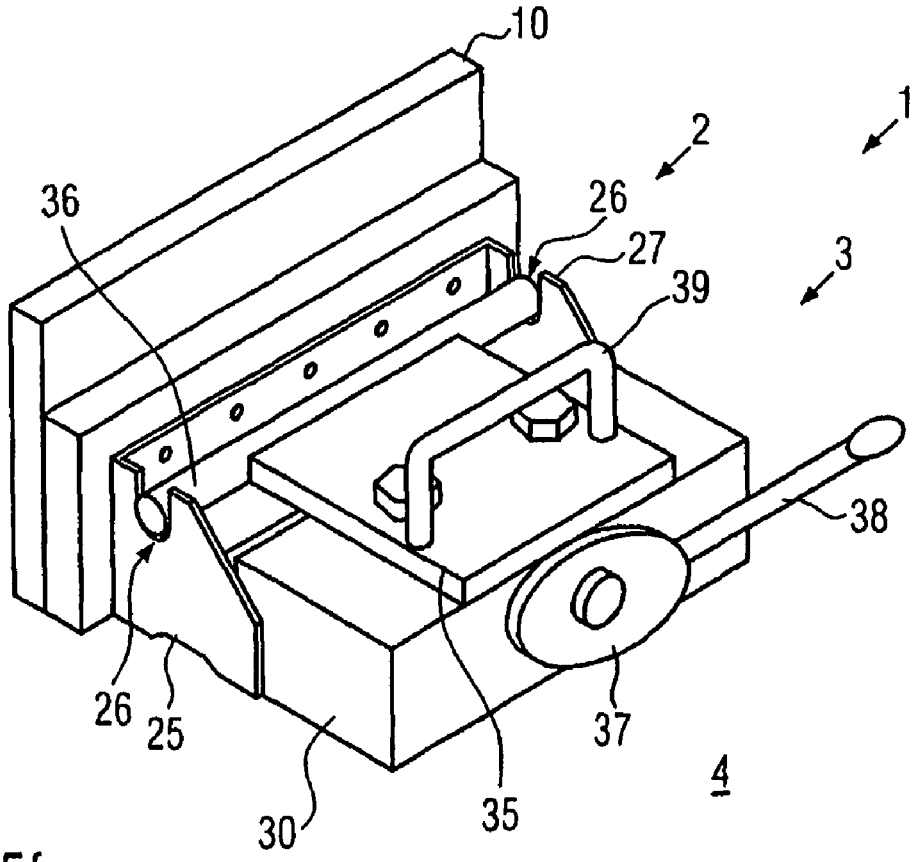
FIG. 5*f* illustrates the formwork system from FIG. 5*e* in an overall view.

To transfer the magnet device 3 from the lowered position illustrated in FIGS. 5*e* and 5*f* into the raised position illustrated in FIGS. 5*c* and 5*d*, the eccentric 37 is rotated by actuating the eccentric lever 38 into a position in which a circumferential section of the eccentric 37 protrudes beyond the underside of the magnet member 30 and lifts the underside of the magnet member 30 from the formwork base 4. In the course of this, the magnetic force developed by the magnet member 30 reduces suddenly and the feet 33 of the magnet device 3 are pressed out of the openings 31 by the spring force of the spring elements 33 until the magnet member 30 is located in the position illustrated in FIGS. 5*c* and 5*d*.

The same magnet device 3 can be used in conjunction with the formwork support 2 of the first embodiment as well as with the formwork support 2 of the second embodiment formed as an angle bracket 27. Furthermore, the formwork support 2 of the first embodiment can also be used independently of the magnet device 3.

The invention claimed is:

1. A formwork system comprising a formwork support, at least one formwork piece borne by the formwork support, a formwork base and a magnetic device movably coupled to the formwork support for fixing a position of the formwork support on the formwork base, the magnetic device comprising a magnetic member which is movable between a raised position in which the formwork support can move together with the magnet device with respect to the formwork base and a lowered position in which the formwork support and the magnetic device are magnetically fixed relative to the formwork base, wherein the formwork support is formed as an angle bracket comprising a back having a plurality of holes provided therein and two limbs extending perpendicularly from the back, each limb being provided with a grooved accommodating slot extending essentially parallel to the back of the angle bracket from an upper side of the limb and the grooved accommodating slots serving as link guides for sliding guide sections of the magnet device.

2. Formwork system according to claim 1, characterised in that the magnet device and the formwork support are detachably coupled together.

3. Formwork system according to claim 1, characterised in that the magnet member can be transferred in an essentially linear movement between the raised position and the lowered position.

4. Formwork system according to claim 3, characterised in that the direction of the linear movement runs essentially perpendicular to the formwork base.

5. Formwork system according to claim 1, characterised in that the formwork system additionally comprises at least one guide device with at least one guide section and at least one receptacle section, wherein the guide section is detachably engaged with the receptacle section.

6. Formwork system according to claim 1, characterised in that the magnet device in the lowered position of the magnet member exerts a force on the formwork support in order to press the support against the formwork base.

7. Formwork system according to claim 5, characterised in that the guide section is permanently joined to the magnet member.

8. Formwork system according to claim 5, characterised in that the guide device comprises at least two guide sections, which protrude from different sides of the magnet member, located essentially on one axis.

9. Formwork system according to claim 5, characterised in that the receptacle section comprises a longitudinal groove and the guide section comprises a projection, which protrudes into the groove.

10. Formwork system according to claim 9, characterised in that the groove is open at one end.

11. Formwork system according to claim 1, characterised in that the formwork support comprises at least two receptacle sections which are arranged spaced from one another in the longitudinal direction of the formwork support.

12. Formwork system according to claim 5, characterised in that the formwork support comprises a longitudinal profile with an essentially C-shaped cross-section, which has a back and two limbs which protrude essentially perpendicular from the back.

13. Formwork system according to claim 12, characterised in that the formwork support comprises at least one essentially flat stiffening element which extends essentially perpendicular to the back and/or perpendicular to the limbs of the profile.

14. Formwork system according to claim 13, characterised in that the stiffening element joins the limbs of the profile together.

15. Formwork system according to claim 13, characterised in that the stiffening element joins the back of the profile to at least one of the limbs.

16. Formwork system according to claim 12, characterised in that the formwork support has at least one opening on the back of the profile in the region between two stiffening elements.

17. Formwork system according to claim 12, characterised in that the limbs of the profile are of different lengths.

18. Formwork system according to claim 1, characterised in that the formwork support has at least three receptacle sections which are approximately equally spaced from one another in the longitudinal direction of the formwork support.

19. Formwork system according to claim 1, characterised in that a guide device of the link guide runs approximately perpendicular to the longitudinal direction of the formwork support.

20. Formwork system according to claim 12, characterised in that the link guide extends approximately over a length which approximately corresponds to half the spacing of the limbs of the C-profile.

* * * * *